US009415994B2

(12) United States Patent
Ouderkirk

(10) Patent No.: US 9,415,994 B2
(45) **Date of Patent: *Aug. 16, 2016**

(54) FUEL CONTAINER AND METHODS

(71) Applicant: Brad C. Ouderkirk, North Ogden, UT (US)

(72) Inventor: Brad C. Ouderkirk, North Ogden, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/572,534

(22) Filed: Dec. 16, 2014

(65) Prior Publication Data

US 2015/0102054 A1 Apr. 16, 2015

Related U.S. Application Data

(63) Continuation of application No. 13/238,376, filed on Sep. 21, 2011, now Pat. No. 8,910,835.

(51) Int. Cl.

| | |
|---|---|
| ***B65D 35/34*** | (2006.01) |
| ***B67D 7/04*** | (2010.01) |
| ***B67D 7/00*** | (2010.01) |
| ***B65D 25/46*** | (2006.01) |

(52) U.S. Cl.

CPC *B67D 7/04* (2013.01); *B65D 25/46* (2013.01); *B67D 7/005* (2013.01); *B65D 2205/00* (2013.01)

(58) Field of Classification Search

CPC ..... B67D 7/04; B67D 7/005; B67D 7/36; B65D 25/46; B65D 47/305; B65D 47/065

USPC ..... 222/484, 483, 482, 254, 167, 257, 324, 222/380, 468, 503, 510, 511, 526, 527, 529, 222/530, 538, 533, 534, 536, 470, 472, 473, 222/1, 471, 323; 137/572, 575

See application file for complete search history.

(56) References Cited

U.S. PATENT DOCUMENTS

| | | | | | |
|---|---|---|---|---|---|
| 470,838 | A | * | 3/1892 | Hart | B65D 47/305 222/534 |
| 515,552 | A | | 2/1894 | Phelps | |
| 515,534 | A | | 5/1894 | James | |
| 521,113 | A | * | 6/1894 | Hart | B65D 47/305 217/87 |
| 756,373 | A | * | 4/1904 | Joyce | A47G 19/12 137/587 |
| 1,283,906 | A | | 11/1918 | Riebel | |
| 1,417,951 | A | * | 5/1922 | Staples | B65D 47/263 222/468 |
| 1,516,706 | A | | 11/1924 | Brookins | |
| 1,537,399 | A | | 5/1925 | Wiswell | |
| 1,555,176 | A | * | 9/1925 | Allen | B65D 47/065 222/154 |
| 1,565,716 | A | | 12/1925 | Wiswell | |
| 1,579,390 | A | | 4/1926 | Peaden | |
| 1,664,560 | A | | 4/1928 | Hughes | |

(Continued)

FOREIGN PATENT DOCUMENTS

| | | |
|---|---|---|
| DE | 10 2007 061 53 A1 | 7/2009 |
| EP | 0 974 525 B1 | 1/2000 |

(Continued)

*Primary Examiner* — J. Casimer Jacyna
*Assistant Examiner* — Benjamin R Shaw
(74) *Attorney, Agent, or Firm* — Holland & Hart

(57) ABSTRACT

A fuel container includes a container, a spout, an outlet valve, an air intake valve, and an actuator. The spout is coupled to the container at a bottom end portion of the container. The outlet valve is positioned at the bottom end portion and operable to control fluid flow into the spout. The air intake valve is positioned at a top end portion of the container. The actuator is operable to open both the outlet valve and the air intake valve concurrently.

22 Claims, 15 Drawing Sheets

(56) References Cited

U.S. PATENT DOCUMENTS

| | | | | | |
|---|---|---|---|---|---|
| 1,808,029 | A | | 6/1931 | Frame | |
| 1,886,472 | A | | 11/1932 | Vincenzo | |
| 1,953,200 | A | | 4/1934 | Thomas | |
| 1,959,961 | A | | 5/1934 | Neil | |
| 2,275,318 | A | | 2/1942 | Rasmussen | |
| 2,516,728 | A | | 7/1950 | Smith | |
| 2,630,247 | A | | 3/1953 | Rafferty | |
| 2,641,385 | A | | 6/1953 | Rives | |
| 3,097,674 | A | | 7/1963 | Allen | |
| 3,901,417 | A | | 8/1975 | Schiemann | |
| 3,915,357 | A | * | 10/1975 | Zehr | B67D 3/00 222/481.5 |
| 4,069,946 | A | | 1/1978 | Flider | |
| 4,125,207 | A | | 11/1978 | Ernst et al. | |
| 4,236,655 | A | | 12/1980 | Humphries | |
| 4,834,270 | A | * | 5/1989 | Messner | F16N 3/04 222/484 |
| 5,277,343 | A | | 1/1994 | Parsonage | |
| 5,472,124 | A | | 12/1995 | Martushev | |
| 5,597,097 | A | | 1/1997 | Morris | |
| 5,671,868 | A | * | 9/1997 | Herr | B65D 25/46 141/1 |
| 5,850,949 | A | | 12/1998 | Koerbel et al. | |
| 6,003,735 | A | | 12/1999 | Strecker | |
| 6,045,013 | A | | 4/2000 | Yang | |
| 6,702,160 | B1 | | 3/2004 | Griffith | |
| 6,983,868 | B1 | | 1/2006 | Harris | |
| 7,086,548 | B2 | | 8/2006 | Bartlett | |
| 7,357,279 | B2 | | 4/2008 | Kuo | |
| 7,513,394 | B2 | | 4/2009 | Bone | |
| 7,802,704 | B2 | | 9/2010 | Hatch et al. | |
| 7,854,357 | B2 | | 12/2010 | Hill | |
| 2009/0032556 | A1 | * | 2/2009 | Zwahlen | B65D 25/46 222/534 |
| 2009/0045226 | A1 | | 2/2009 | Munlin | |

FOREIGN PATENT DOCUMENTS

| | | | |
|---|---|---|---|
| GB | 2 306 151 | A | 4/1997 |
| GB | 2470574 | A | 1/2010 |
| WO | 2010100484 | A1 | 10/2010 |

* cited by examiner

FUEL CONTAINER AND METHODS

RELATED APPLICATION

This is a continuation of U.S. patent application Ser. No. 13/238,376 filed on 21 Sep. 2011, now U.S. Pat. No. 8,910,835, issued 16 Dec. 2014, the disclosure of which is incorporated, in its entirety, by this reference.

TECHNICAL FIELD

The present disclosure relates to fuel containers, and more particularly relates to portable fuel containers, features for dispensing the contents of a fuel container, and related methods of operating a fuel container to dispense the contents of the fuel container.

BACKGROUND

Portable containers for transporting liquid fuel such as gasoline provide a convenient way of replenishing expended fuels in devices that require periodic fueling (e.g., lawnmowers, vehicles, generators, etc.). Portable liquid fuel containers (e.g., gas cans) are commonly made of plastic and include a removable nozzle that connects to a fill opening of the container. The gas can is usually tipped to pour the fuel out of the nozzle. An air inlet is sometimes provided along the top side of the gas can to equalize pressure within the gas can for improved outflow of fuel through the nozzle.

Controlling the flow rate and the amount of fuel dispensed from the gas can be difficult, and is highly dependent on the tilt angle of the gas can, the amount of fuel contained in the gas can, a size of the nozzle opening, and the rate of air flow into the gas can during dispensing. As a result of these many variables, the vehicle or equipment being filled by the gas may be overfilled. Once fluid flow is set in motion, excess fluid readily collects and moves through the nozzle. Consequently, a rapid movement of the gas can to a non-dispensing position to stop the fluid flow sometimes fails to correct an overfill. Fluid overflows are hazardous, wasteful and may damage the environment and equipment upon which the fluid spills.

SUMMARY

One aspect of the present disclosure relates to a fuel container that includes a container, a spout, an outlet valve, an air intake valve, and an actuator. The container has a top end portion and a bottom end portion, and defines a hollow interior. The spout is coupled to the container at the bottom end portion of the container. The outlet valve is positioned at the bottom end portion and operable to control fluid flow into the spout. The air intake valve is positioned at the top end portion of the container. The actuator is operable to open both the outlet valve and the air intake valve.

The actuator may be operable to concurrently open the outlet valve and the air intake valve. The outlet valve may include a stopper plug that moves between a first position sealing closed a fluid path between the hollow interior and the spout, and a second position permitting fluid flow between the hollow interior and the spout. The spout may be rotatable from a retracted position to an extended position relative to the container. The container may also include a fluid channel position in the hollow interior and coupled in fluid communication with the spout. The outlet valve may control fluid flow into the fluid channel.

The container may also include a flow valve rod coupled between the air intake valve and the outlet valve. Operation of the air intake valve with the actuator moves the flow valve rod to operate the outlet valve. At least one of the air intake valve and the outlet valve may be mounted directly to the flow valve rod. The flow valve rod may be positioned within the hollow interior. The outlet valve may be biased into a closed position. The container may include a handle portion positioned at the top end portion of the container, and the actuator is operable at a location adjacent to the handle portion.

Another aspect of the present disclosure relates to a fuel storage device that includes a container, an air intake valve, an air outlet valve, and a flow valve rod. The air intake valve is coupled in fluid communication with a source of air and operable to control air flow into the container. The outlet valve is in fluid communication with a volume of fluid carried in the container and operable to control fluid flow out of the container. The flow valve rod is connected to the air intake valve and the outlet valve. Operating the flow valve rod concurrently operates the air intake valve and the outlet valve.

The fuel storage device may also include an actuator connected to the air intake valve, wherein operating the actuator to open and close the air intake valve causes the flow valve rod to open and close the outlet valve. The fuel storage device may also include a spout coupled in fluid communication with the outlet valve. A spout valve may be positioned between the outlet valve and the spout. The spout valve may be operable between open and closed positions as the spout is moved between a dispense position and a stowed position. The outlet valve may be positioned at a bottom end portion of the container and the air intake valve may be positioned at a top end portion of the container. The air intake valve, the flow valve rod and the outlet valve may be positioned within the container.

A further aspect of the present disclosure relates to a method of operating a fuel container assembly. The method includes providing an air intake valve, an outlet valve, a valve actuator, and a container configured to hold a volume of fuel. The method includes opening the air intake valve with the actuator to provide a supply of air into the container, and opening the outlet valve with the actuator to permit exit of the volume of fuel from the container.

Opening the air intake valve and the outlet valve may occur concurrently. The method may also include providing a spout coupled in fluid communication with the outlet opening, wherein the spout is connected to the container at a bottom end portion of the container and is pivotal relative to the container. The method may also include providing a spout valve positioned between the outlet opening and an outlet opening of the spout, wherein the spout valve is operable between open and closed positions as the spouts pivots between a dispense position and a stowed position.

The foregoing and other features, utilities and advantages of the invention will become apparent from the following detailed description of the invention with reference to the accompanying drawings.

BRIEF DESCRIPTION OF THE DRAWINGS

The accompanying drawings illustrate various embodiments and are a part of the specification. The illustrated embodiments are mainly examples and do not limit the claims.

DETAILED DESCRIPTION

Figure 1:
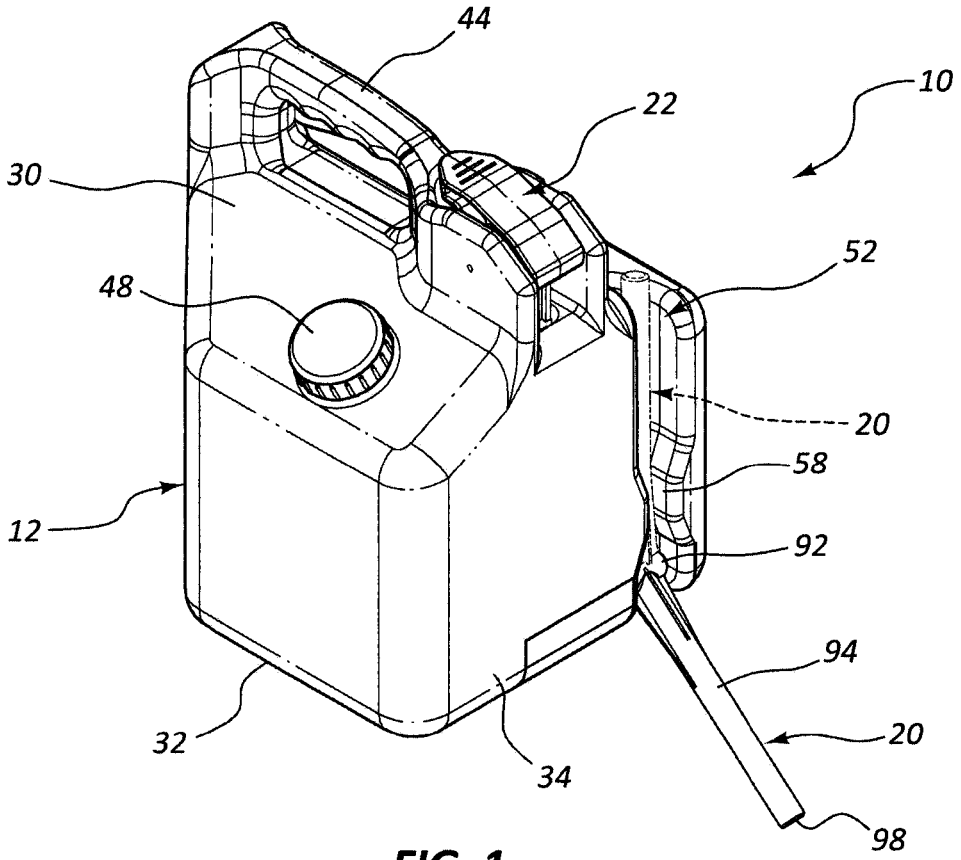
FIG. 1 is a perspective view of an example fuel container device in accordance with the present disclosure.
Figure 2:
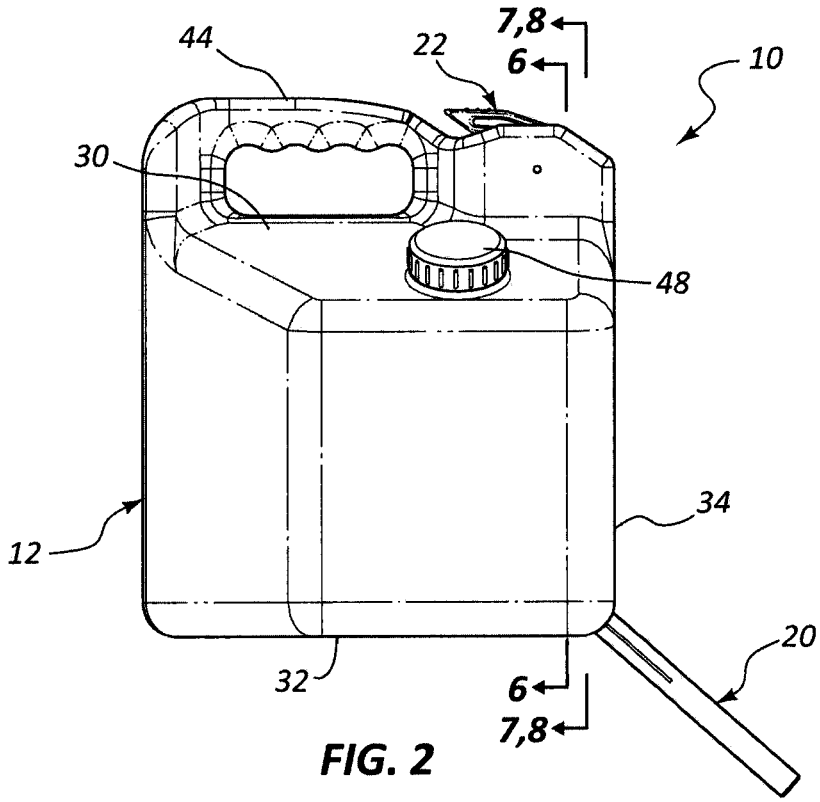
FIG. 2 is a right-side view of the fuel container device of FIG. 1.
Figure 3:
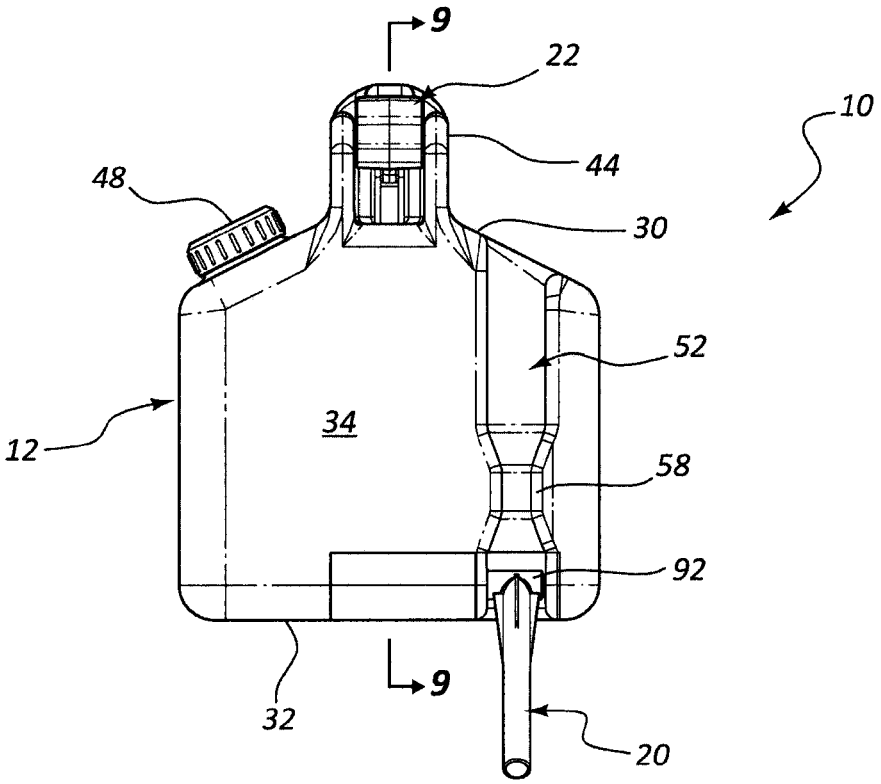
FIG. 3 is a front view of the fuel container device of FIG. 1.
Figure 4:
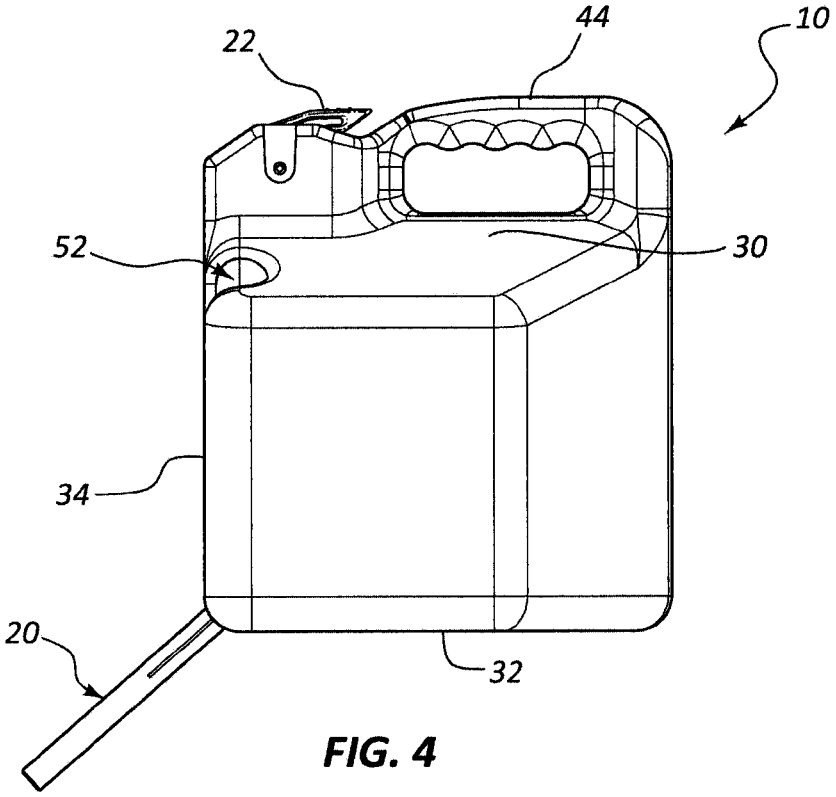
FIG. 4 is a left-side view of the fuel container device of FIG. 1.

The present disclosure relates to a fuel container and related methods of operating a fuel container. The fuel containers disclosed herein are typically handheld, portable containers often referred to as gas cans. Although the example fuel containers disclosed herein are of the type that may be moved and carried by a single user, the principals disclosed herein may be applicable to other types of containers, such as containers that are much larger and intended to remain stationary, or containers intended to hold other types of fluids besides liquid fuel.

Dispensing fuel from a fuel container typically requires some control of fluid flow (e.g., the flow of liquid fuel) out of the container and some control of air intake into the container that helps maintain a pressure condition that permits the dispensing of the fluid contained in the fuel container. The example fuel containers disclosed herein may provide control of the fluid dispensing and air intake in a convenient, simple, and easy-to-use manner. In one example, the fluid dispensing and air intake are controlled by separate valve members that are operable with a single actuator. The actuator, when operated, may concurrently open and close both a fluid output valve and an air intake valve. Typically, the air intake valve is positioned at a top end of the container above a fluid (e.g., liquid) level within the fuel container, and the fluid outlet valve is positioned at a bottom end of the fuel container to have maximum exposure to the fluid held in the fuel container.

The example fuel containers disclosed herein may also include an outlet spout. The outlet spout may be coupled in fluid communication with the fluid outlet valve. The spout may be movable between a dispense position and a stowed position. A spout valve may be positioned in a flow channel between the spout and the fluid outlet valve. The spout valve may be operable between open and closed positions as the spout is moved between dispense and stowed positions. The spout valve may provide additional control of fluid flow out of the fuel container (e.g., prevent fluid flow out of the spout until the spout is moved into the dispense position).

The fuel container may include a housing or container structure to which the actuator, air intake valve, fluid outlet valve, spout, and other features are mounted to or carried by. The container may be configured to hold the spout in a stowed position. The container may also include a handle to improve ease in handling or carrying the fuel container device. The container may also include a fill opening and associated cap used to fill the fuel container. The actuator, air intake valve, fluid outlet valve, spout, and spout valve may be positioned and operable separate from the fill opening.

Referring now to FIGS. 1-9C, an example fuel container device 10 is shown and described. The fuel container device 10 includes a container 12, an air intake valve 14 (see FIGS. 5-9C), an outlet valve 16 (see FIGS. 5-9C), a flow valve rod assembly 18 (see FIGS. 5-9C), a spout 20, and an actuator assembly 22 (see FIGS. 1 and 5-6). The air intake valve 14, outlet valve 16 and flow valve rod assembly 18 are positioned within the container 12.

Figure 9A:
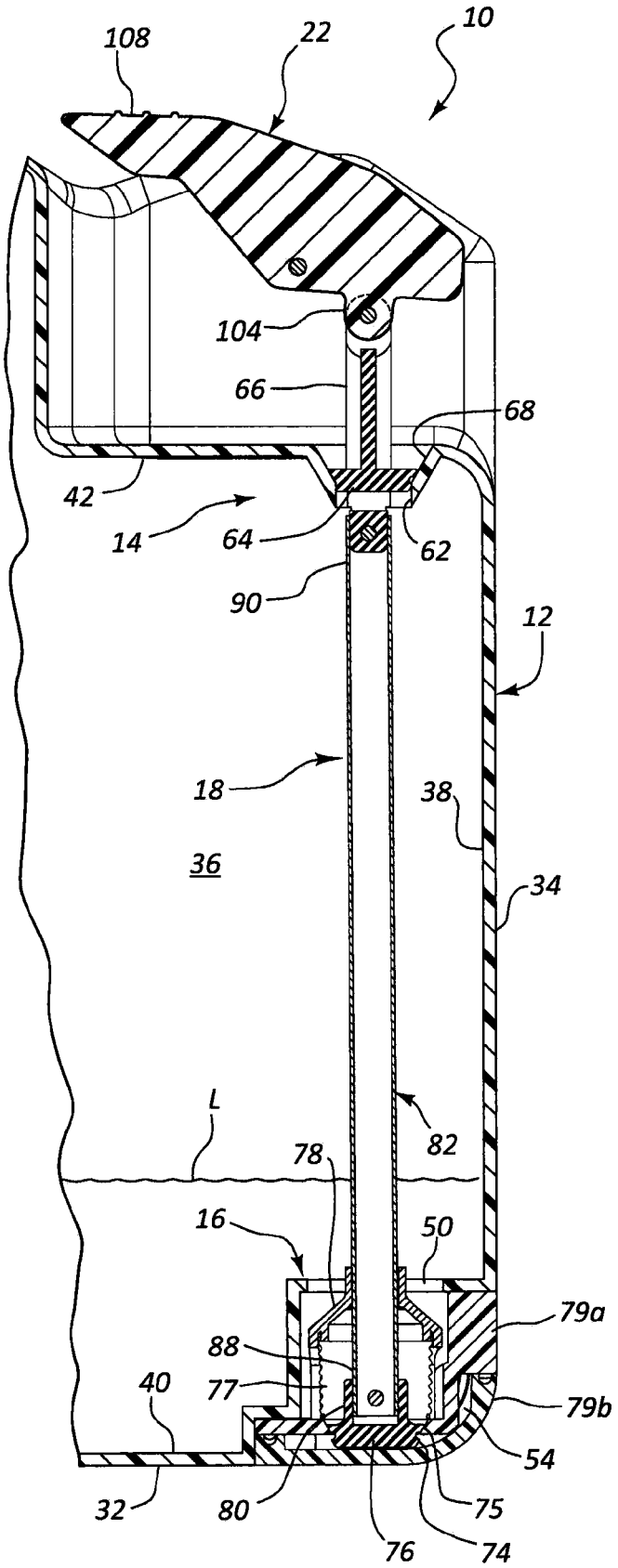
FIG. 9A is a cross-sectional view of the fuel container device of FIG. 3 taken along cross-section indicators 9-9 with inlet and outlet valves in a closed position.
Figure 9B:
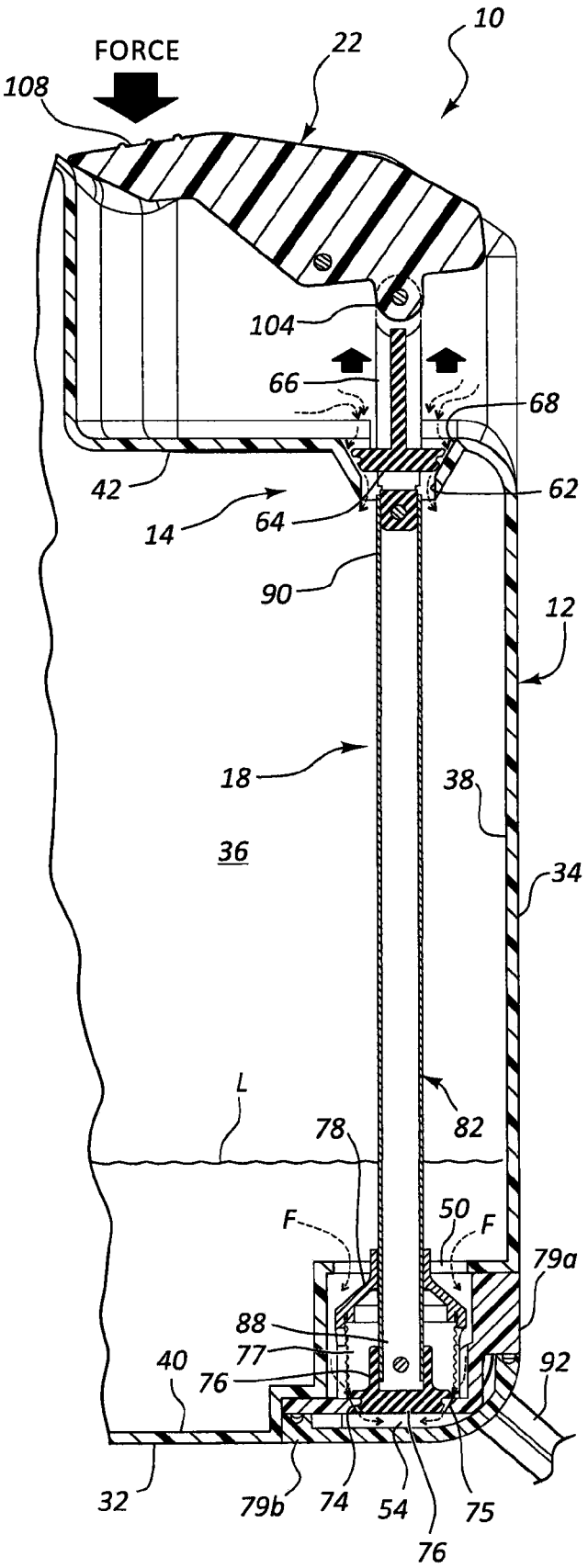
FIG. 9B shows the cross-sectional view of FIG. 9A with inlet and outlet valves in an open position.

The actuator assembly 22 is accessible on an exterior of the container 12, such as, for example, at a top end of the container 12 adjacent to a handle of the container. In one embodiment, the actuator assembly 22 is positioned for operation by a user, for example, using the user's thumb of one hand while the fingers of that same hand are grasping the handle feature of the container 12. This one hand operation capability for operating the actuator assembly 22 may permit the user to perform other functions with an opposite hand such as, for example, directing a position of the spout 20 or preparing a separate container to be filled with fuel from the fuel container device 10. FIGS. 9A and 9B show operation of the actuator assembly to open and close the air intake valve 14 and outlet valve 16.

Figure 5:
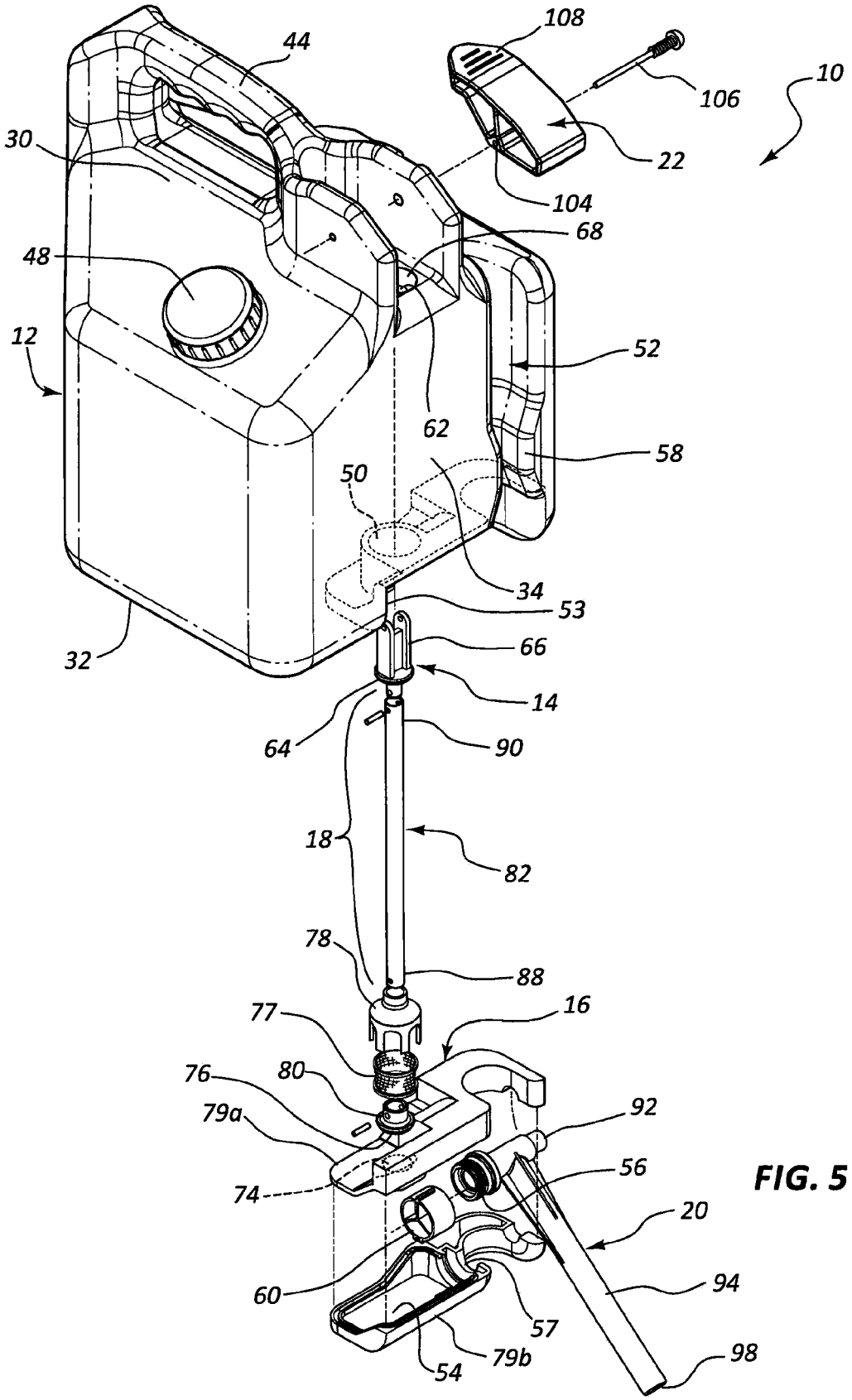
FIG. 5 is an exploded perspective view of the fuel container device of FIG. 1.
Figure 8:
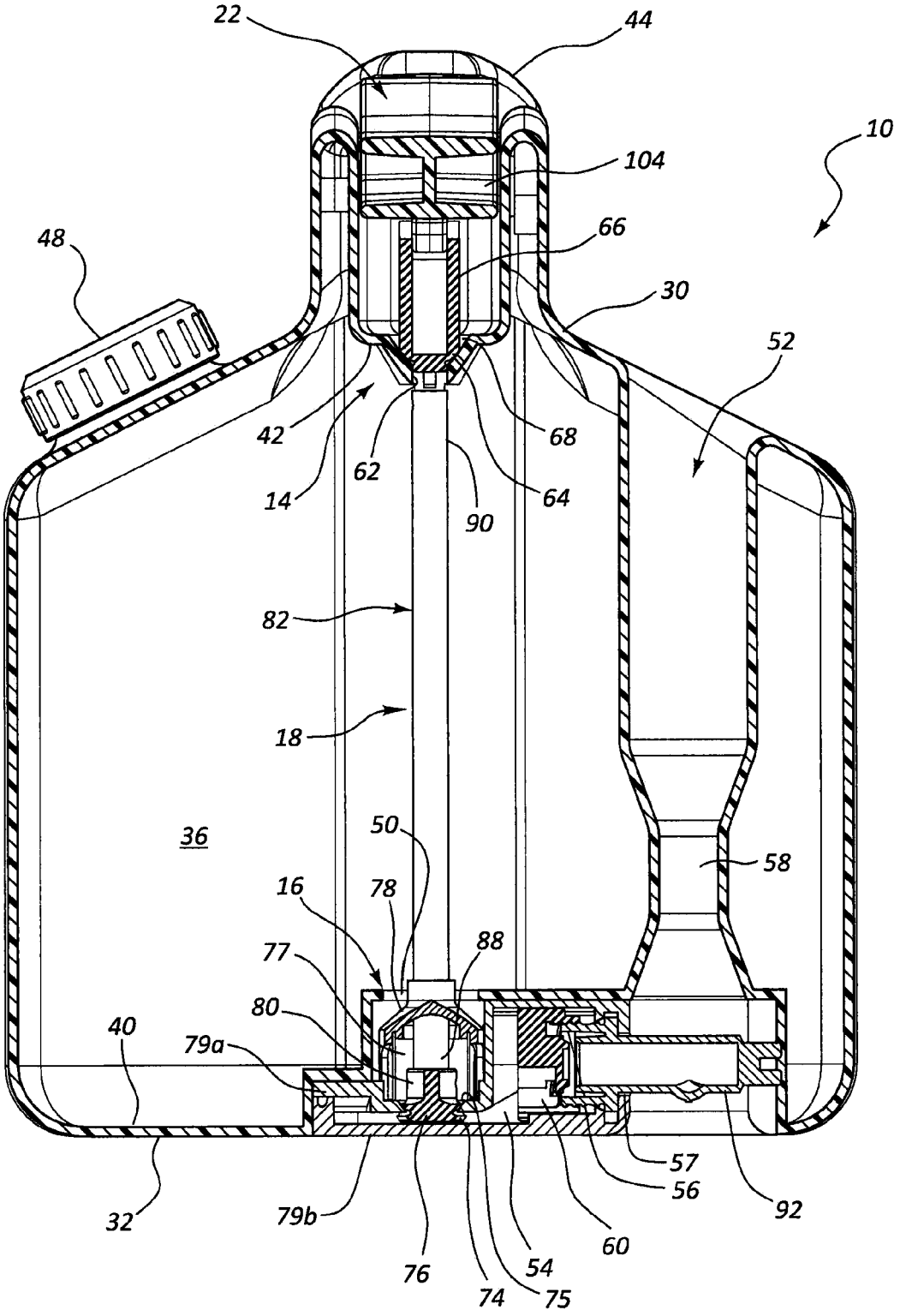
FIG. 8 is a cross-sectional view of the fuel container device of FIG. 2 taken along cross-section indicators 8-8.

Referring now to FIGS. 1, 5 and 8, the container 12 includes a top end 30, a bottom end 32, a front side 34, and a hollow interior 36. The interior of the container 12 includes an internal front surface 38, an internal bottom surface 40, and an internal top surface 42. The air intake valve 14 is typically positioned at the top end 30 along the internal top surface 42. The outlet valve 16 is typically positioned at the bottom end 32 adjacent to the internal bottom surface 40 and adjacent to the internal front surface 38. The flow valve rod assembly 18 is typically positioned adjacent to the internal front surface 38 within the hollow interior 36.

Figure 9C:
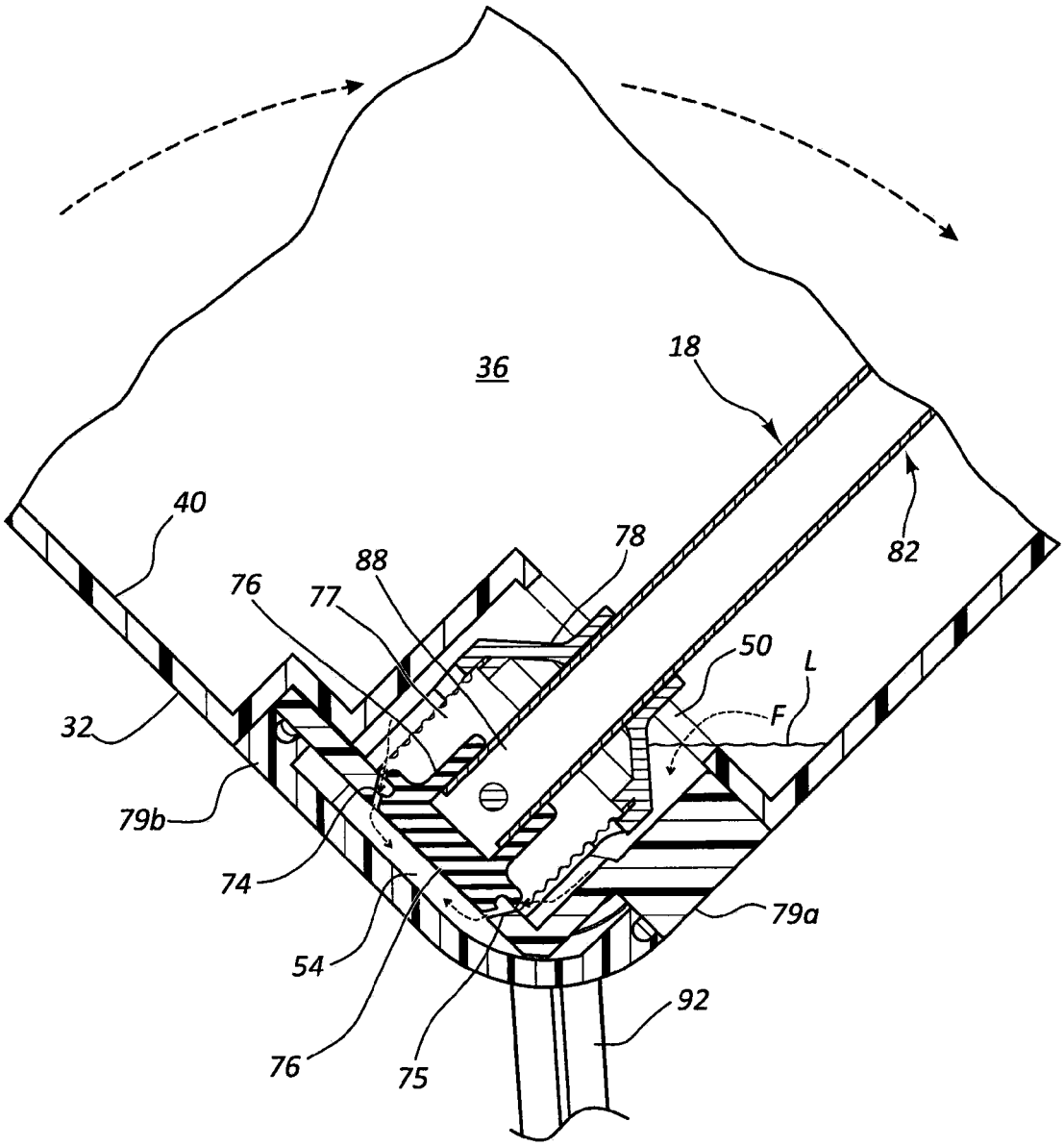
FIG. 9C shows the cross-sectional view of FIG. 9B with fuel container device tipped forward to assist in dispensing.

The container 12 may also include a handle portion 44, a cap 48 that provides access to a fill opening 46 (see FIG. 5), a flow opening 50, a spout recess 52, and an outlet valve recess 53. The flow opening 50 may be arranged and configured to permit the flow valve rod assembly 18 to pass therethrough (see FIG. 6) and provide a flow path for the contents of the container 12 to be exposed to the outlet valve 16. FIGS. 9A and 9B shows a content level L in the container 12 that is exposed to the outlet valve 16 through the flow opening 50. By tilting the container 12 forward as shown in FIG. 9C, the contents of the container 12 (shown by level L) may continue to be exposed to the outlet valve 16 to drain substantially all of the contents out of the container 12.

The spout recess 52 may include a connector portion 58 and be configured to retain the spout 20 in a stowed position (see FIG. 1). In some arrangements, the spout recess 52 is defined in a vertical corner portion of the container 12 rather than being spaced from the vertical corners as shown in the figures.

The container 12 may have many different shapes and sizes such as, for example, a cylindrical shape with a generally circular or oval cross-section, or a generally cubicle shape such as the design of FIGS. 1-9C. The handle portion 44 may be positioned at various locations on the container, such as along a rear side of the container 12. Alternatively, multiple handle portions may be positioned on the container 12 to improve ease of handling the fuel container device 10 during use and storage. One advantage related to the example fuel container devices disclosed herein is that the container 12 does not need to be tipped forward during dispensing of the contents of the container. The valves of the fuel container device 10 control fluid flow rather than a tipping action that directs fluid through a spout that is positioned, for example, at a top end of the container and is exposed to fluid only upon tipping of the container. Dispensing fuel may occur by holding fuel container device 10 in an upright position, manipulating the spout 20 into a desired dispense position, and operating the actuator assembly 22 to control the fluid flow out of the container 12 through the spout 20.

Figure 6:
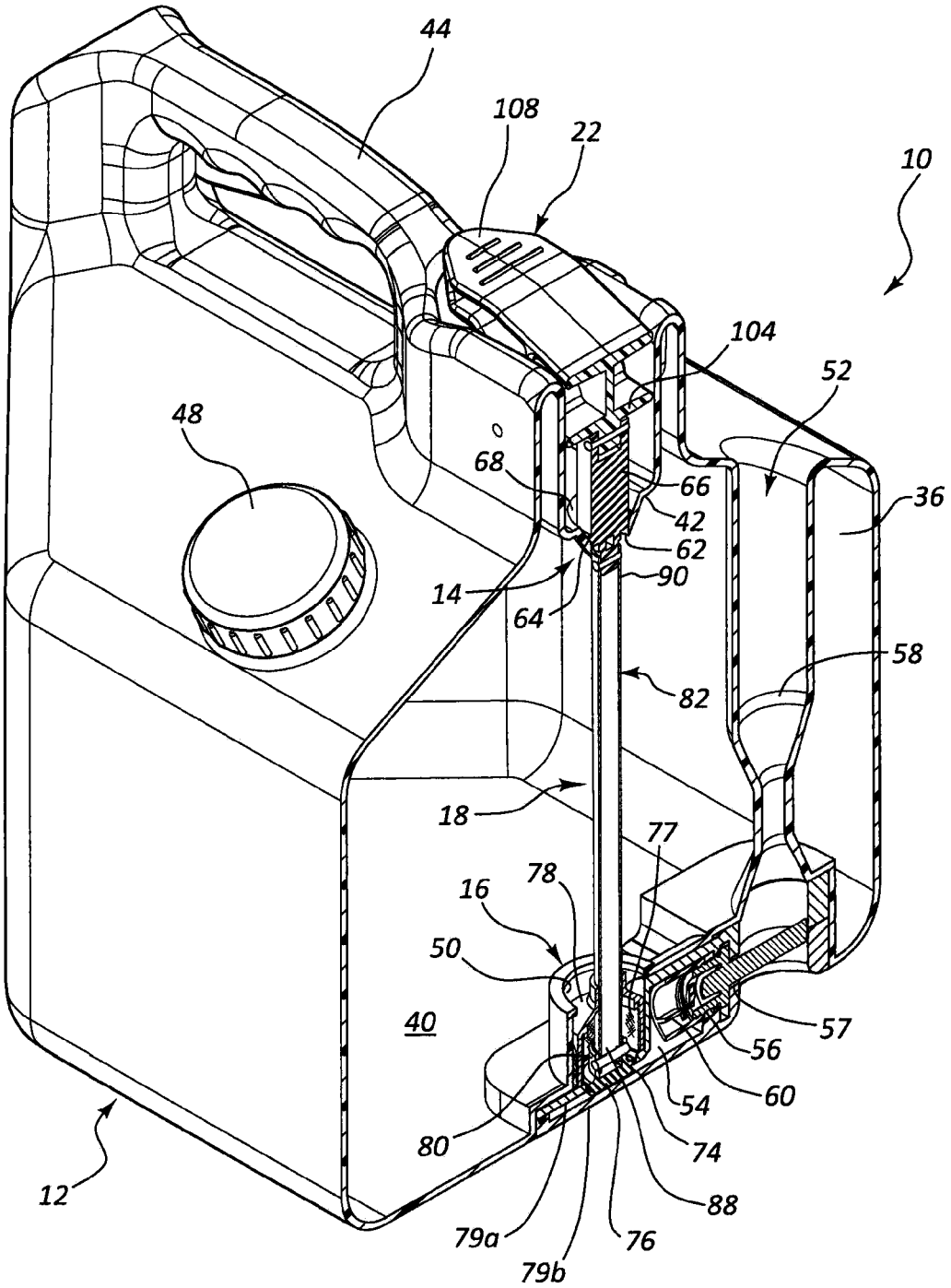
FIG. 6 is a perspective cross-sectional view of the fuel container device of FIG. 2 taken along cross-section indicators 6-6.
Figure 7:
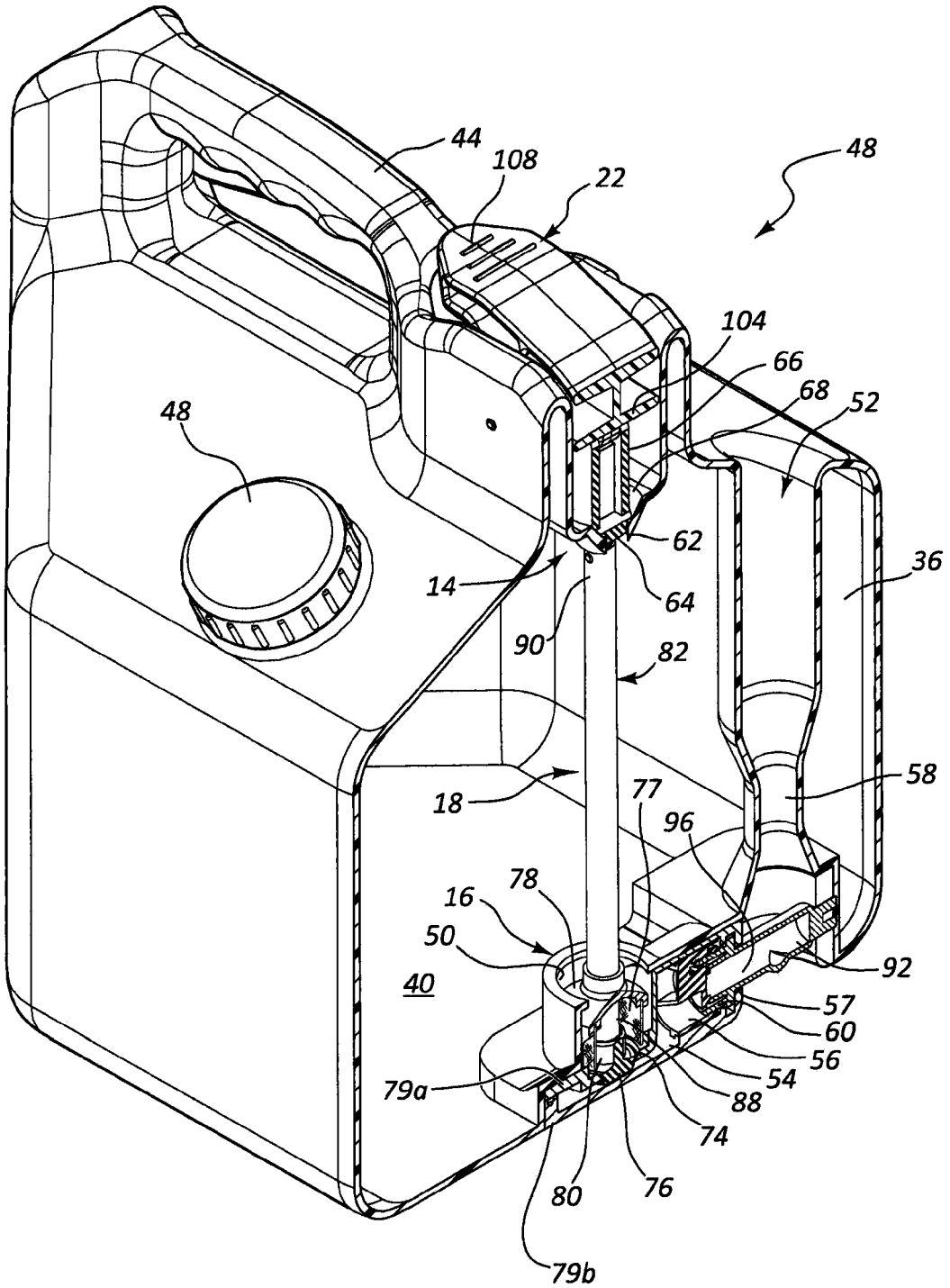
FIG. 7 is a perspective cross-sectional view of the fuel container device of FIG. 2 taken along cross-section indicators 7-7.

Referring to FIGS. 5 and 6, the air intake valve 14 includes an intake valve opening 62, an inlet plug 64, and an actuator connector 66. The intake valve opening 62 may be defined in the container 12. The intake valve opening 62 may be defined at, for example, the top end 30 near the front side 34 of the container 12.

The inlet plug 64 may be configured to move into and out of contact with a tapered side surface 68 leading to the intake valve opening 62. The inlet plug 64 may have a generally cylindrical construction with a circular cross-section. The inlet plug 64 may include a plurality of sealing surfaces such as, for example, a plurality of o-ring type structures that contact the tapered side surface 68 to seal closed the intake valve opening 62. The inlet plug 64 may be connected to and carried by the actuator connector 66. The actuator connector 66 may extend vertically to provide a connection with the actuator assembly 22. Moving the actuator connector 66 vertically up and down may move the inlet plug 64 into and out of contact with the tapered side surface 68 to control air flow through the intake valve opening 62.

Referring to FIGS. 5-9C, the outlet valve 16 includes an outlet valve opening 74, a tapered surface or seat 75 leading to the outlet valve opening 74, an outlet plug 76, a screen 77, a seal member 78, a housing 79*a,b*, and a rod connector 80. The outlet plug 76 is movable relative to the tapered surface 75 to open or seal closed the outlet valve opening 74. The outlet valve opening 74 and tapered surfaced 75 are defined in the housing 79*a,b*. The housing 79*a,b* may define, at least in part, a flow channel 54. The screen 77 may limit the flow of solid particles held in the container 12 through the outlet valve opening 74. The screen 77 may include different types of materials and structures such as, for example, filter material in the form of cloth or fibrous material, or metal material such as a stainless steel screen. The seal member 78 may also provide a screening function and may comprise a screen material. The seal member 78 may interface with the flow valve rod assembly 18, for example, by providing a sealing interface with a portion of the flow valve rod assembly 18. The rod connector 80 may be used to connect the outlet plug 76 to the flow valve rod assembly 18.

Operating the outlet valve 16 may include moving the outlet plug 76 into and out of contact with the tapered surface 75 to control fluid flow through the outlet valve opening 74. In one example, the outlet plug 76 is moved vertically into and out of contact with the tapered surface 75. The outlet plug 76 may have a generally cylindrical construction with a circular cross-section. The outlet plug 76 may include a plurality of o-ring type structures. The outlet plug 76 may provide a plurality of sealing surfaces that contact the tapered surface 75 to seal closed the outlet valve opening 74. The outlet valve 16 may be operable by moving the flow valve rod assembly 18.

A valve seat 60 may be positioned within the flow channel 54 and sized to receive and interface with the flow channel valve 56 (see FIGS. 5 and 6). The valve seat 60 may be a separate piece that interfaces with the flow channel valve 56, or may be integrally formed with other features such as portion of a housing 79*a,b* of the outlet valve 16 (see FIGS. 5-6).

The spout 20 may extend into the housing 79*a,b* through a spout opening 57. The flow channel valve 56 may cooperate with the spout 20 to control fluid flow through the flow channel 54 and into the spout 20. The flow channel valve 56 may be operable between a closed position and an open position upon rotation of the spout 20 between the stowed position within the spout recess 52 and a dispense position rotated out of the spout recess 52 (see FIG. 1). The flow channel valve 56 may be referred to as a spout valve, a second fluid control valve, or a safety valve. The flow channel valve 56 may provide a secondary control of fluid flow out of the container 12. The flow channel valve 56 may limit flow until the spout 20 in a dispense position, even if the actuator assembly 22 is operated to open the air intake valve 14 and outlet valve 16. The flow channel valve 56 may be carried on a portion of the spout 20 (e.g., the connector portion 92 as shown in FIG. 5). The flow channel valve 56 may be a compression valve that interfaces with the valve seat 60 to open and close a flow path into the spout 20.

Referring again to FIGS. 5-9C, the flow valve rod assembly 18 may include a rod 82 having a bottom end 88 and a top end 90. The bottom end 88 may be connected to the outlet plug 76 with the rod connector 80. The top end 90 may be connected to the inlet plug 64, for example, via the actuator connector 66. The flow valve rod assembly 18 may couple together the inlet plug 64 and outlet plug 76. The flow valve rod assembly 18 may provide concurrent operation of the air intake valve 14 and outlet valve 16.

In some arrangements, the flow valve rod assembly 18 may include multiple rod members, biasing members, and other features that assist in, for example, delivering a flow of air to a bottom end of the container 12, biasing closed one or both of the intake valve opening 62 and outlet valve opening 74, or providing a sequential movement of the inlet plug 64 and outlet plug 76 upon operation of the actuator assembly 22.

Referring to FIGS. 1, 5 and 6, the spout 20 may include a connector portion 92 and an outlet portion 94. The connector portion 92 may include an inlet end 96 that extends through the spout recess 52 and is in fluid communication with the flow channel 54 via the flow channel valve 56. The connector portion 92 may define a pivot axis about which the outlet portion 94 pivots between stowed and dispense positions. The outlet portion 94 may include an outlet opening 98. Fluid flowing from the container 12 may exit the fuel container device 10 through the outlet opening 98.

The outlet portion 94 may include features that assist in retaining the spout 20 in a stowed position (e.g., a recess or protrusion that interfaces with the connector portion 58 of the spout recess 52). The outlet portion 94 may include a bendable portion or other feature that helps the user direct the outlet opening 98 into a desired dispense position when dispensing the contents of the container 12. The connector portion 92 and outlet portion 94 may have a generally circular cross-section and tubular construction. The connector portion 92 and outlet portion 94 may be formed as a single, integral piece. Alternatively, the connector portion 92 and outlet portion 94 may be separately formed pieces that are assembled together in a separate step.

The flow channel valve 56 may be positioned within the connector portion 92 and may have portions that are positioned on both the interior and exterior surfaces of the connector portion 92. The flow channel valve 56 may provide a sealed interface between the connector portion 92 and the housing 79*a,b*.

Referring to FIG. 5, the actuator assembly 22 includes a connector portion 104, a pivot member 106, and an actuation portion 108. The actuation portion 108 is typically positioned adjacent to the handle portion 44. The pivot member 106 provides a pivot connection to the container 12. The pivot member 106 may include, for example, a pivot rod that extends into contact with a pivot surface (e.g., an aperture) of the container 12. The connector portion 104 may be connected to the actuator connector 66 with a pivot member 102.

Applying a force to the actuation portion 108 may pivot the actuator assembly 22 about the pivot member 106 to move the actuator connector 66 in an axial direction. Moving the actuator connector 66 in an axial direction may move the inlet plug 64 and outlet plug 76 in an axial direction to control flow through the intake valve opening 62 and outlet valve opening 74, respectively. In some arrangements, the actuator assembly 22 is biased into a closed or sealed position. Applying a force to the actuation portion 108 sufficient to overcome the biasing forces may move the actuator connector 66 axially to open the intake valve opening 62 and outlet valve opening 74. In some arrangements (not shown), the actuator assembly 22 may include first and second actuation portions, wherein a first actuation portion operates the air intake valve and outlet valves into an open position, and applying a force to the second actuation portion closes the air intake valve and outlet valve.

In other arrangements, separate actuator assemblies may be used to operate each of the air intake valve 14 and outlet valve 16. The actuator assemblies may include actuators positioned at different locations on the container 12 that are spaced apart from each other. Alternatively, the actuator assemblies may include actuators that are positioned adjacent to each other for easy access and operation by an operator holding the handle portion 44 of the container 12.

In a still further embodiment, a separate actuator assembly may be used to control the flow channel valve 56 rather than having the flow channel valve 56 operate automatically by rotating the spout between stowed and dispensed positions. The flow channel valve may be positioned within the flow channel to provide a safety or secondary flow control. This flow channel valve may be operable by an actuator assembly that is also accessible along, for example, a top end of the container adjacent to the handle portion 44. In a further embodiment, a single actuator assembly may be used to operate all three of the air intake valve, outlet valve and flow channel valve either concurrently or in series or sequence. For example, an actuator assembly operated into a first position may open the air intake valve and outlet valve and operating the actuator assembly into a second position may operate the flow channel valve in a two-stage valving operation.

Referring now to FIGS. 10-17B, another example fuel container device 100 is shown and described. The fuel container device 100 includes a container 112, an air intake valve 114 (see FIGS. 14-17B), an outlet valve 116 (see FIGS. 14-17B), a flow valve rod assembly 118 (see FIGS. 14-17B), a spout 120, and an actuator assembly 122 (see FIGS. 10-16). The air intake valve 114, outlet valve 116 and flow valve rod assembly 118 are positioned within the container 112.

The actuator assembly 122 is accessible on an exterior of the container 112, such as, for example, at a top end of the container 112 adjacent to a handle of the container. In one embodiment, the actuator assembly 122 is positioned for operation by a user, for example, using the user's thumb of one hand while the fingers of that same hand are grasping the handle feature of the container 112. This one hand operation capability for operating the actuator assembly 122 may permit the user to perform other functions with an opposite hand such as, for example, directing a position of the spout 120 or preparing a separate container to be filled with fuel from the fuel container device 110.

Figure 10:
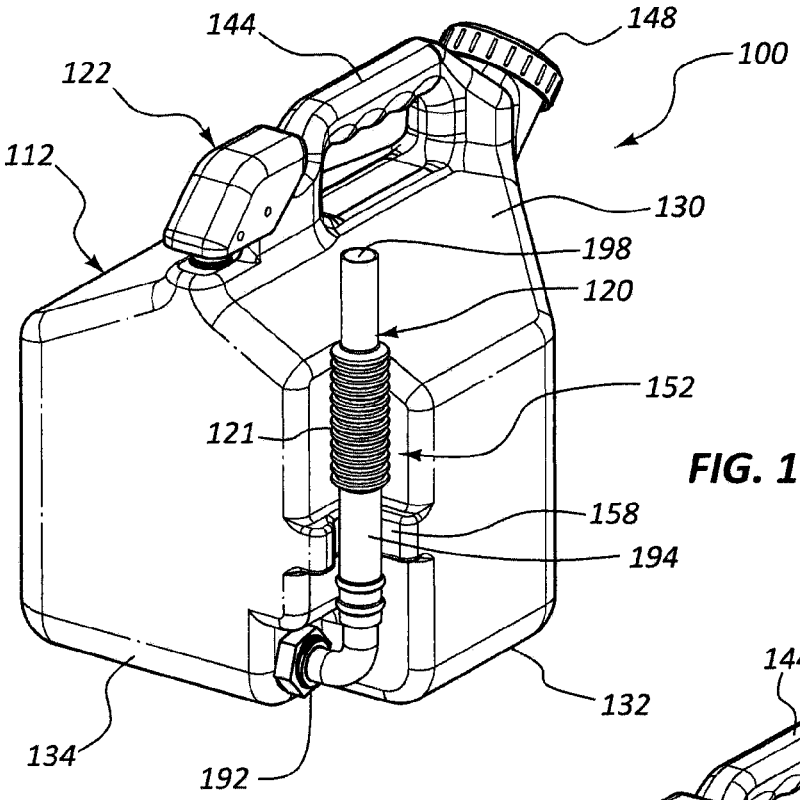
FIG. 10 is a perspective view of an example fuel container device in accordance with the present disclosure with a spout in a stowed position.
Figure 14:
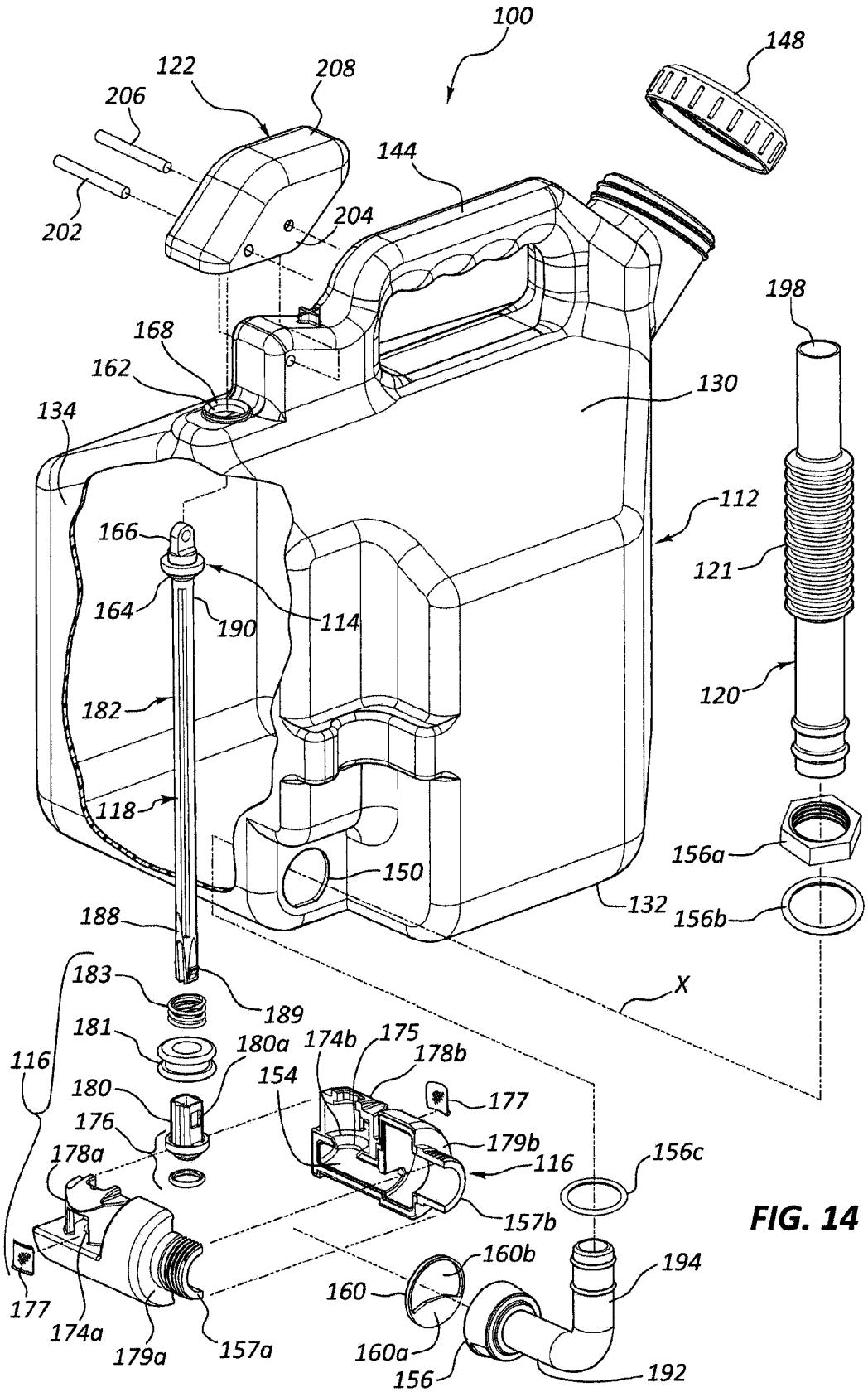
FIG. 14 is an exploded perspective view of the fuel container device of FIG. 10.
Figure 16:
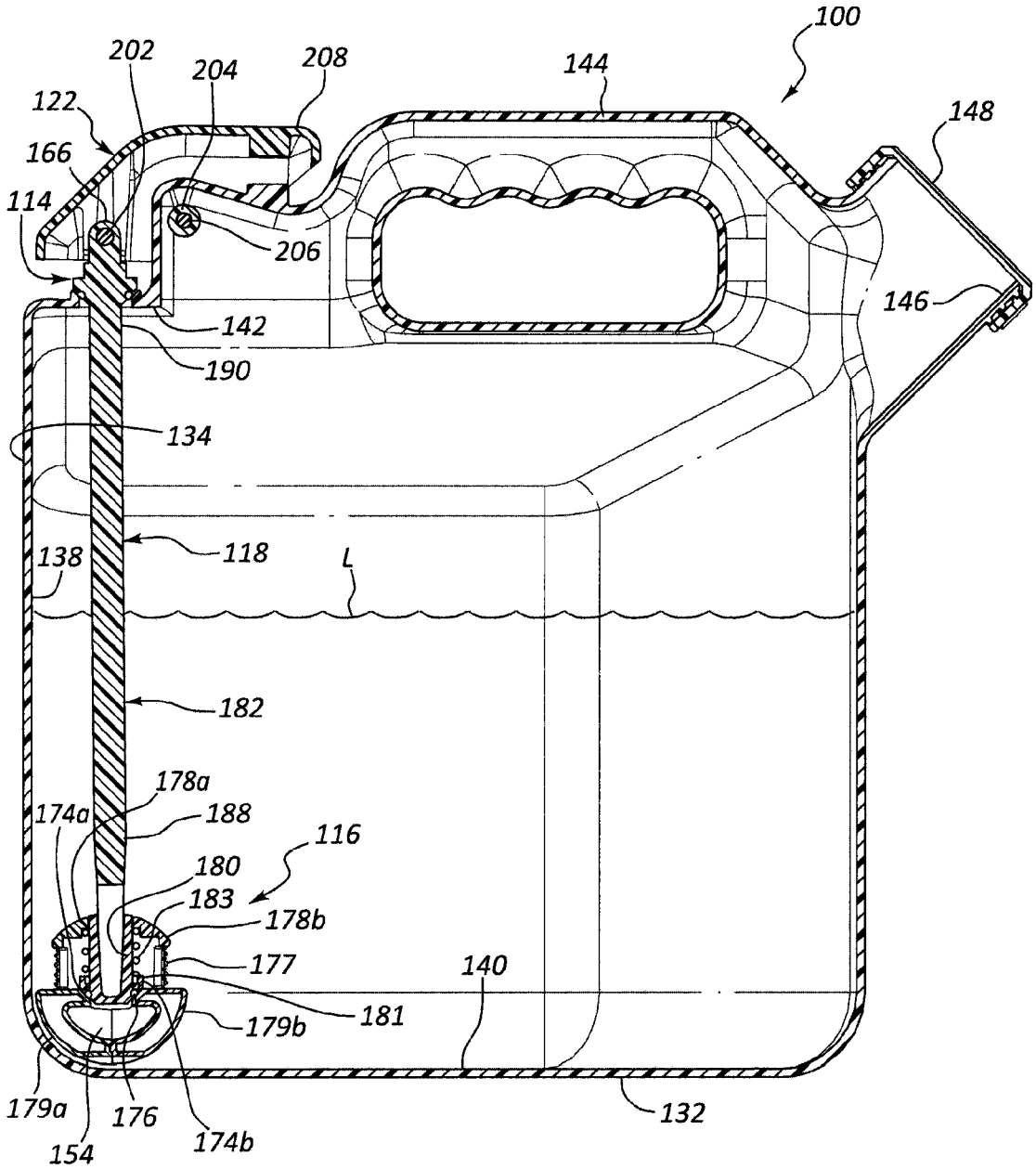
FIG. 16 is a cross-sectional view of the fuel container device of FIG. 13 taken along cross-section indicators 16-16.

Referring now to FIGS. 10, 14 and 16, the container 112 includes a top end 130, a bottom end 132, a front side 134, and a hollow interior 136. The interior of the container 112 shown in FIG. 16 includes an internal front surface 138, an internal bottom surface 140, and an internal top surface 142. The air intake valve 114 is typically positioned at the top end 30 along the internal top surface 142. The outlet valve 116 is typically positioned at the bottom end 132 adjacent to the internal bottom surface 140 and adjacent to the internal front surface 138. The flow valve rod assembly 118 is typically positioned adjacent to the internal front surface 138 within the hollow interior 136.

Figure 11:
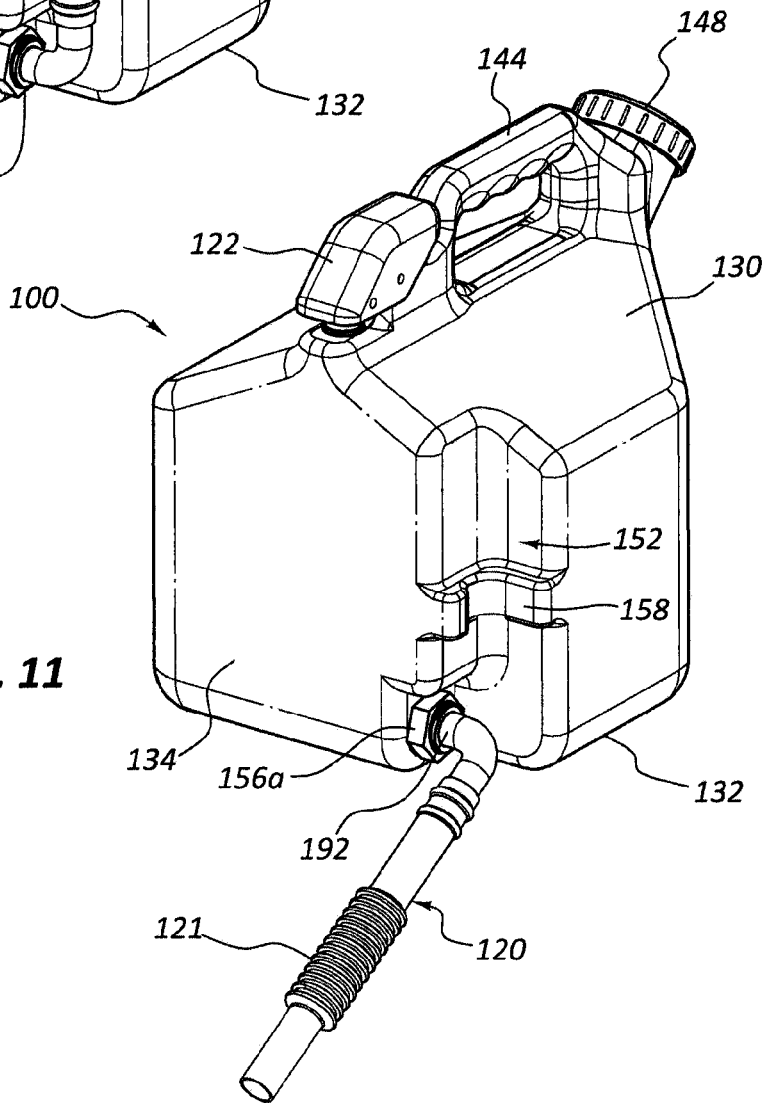
FIG. 11 is a perspective view of the fuel container device of FIG. 10 with the spout in a dispense position.

The container 112 may also include a handle portion 144, a cap 148 that provides access to a fill opening 146 (see FIG. 16), an outlet opening 150 (see FIG. 14), and a spout recess 152 (see FIGS. 10-11). The outlet opening 150 may be arranged and configured to permit the spout 120 to pass therethrough (see FIGS. 14-15).

The spout recess 152 may include a connector portion 158 (see FIG. 11) and be configured to retain the spout 120 in a stowed position (see FIG. 10). The spout recess 152 is defined in a vertical corner portion of the container 112 rather than being spaced from the vertical corners as shown in the embodiment of FIGS. 1-8. The connection portion 158 may provide an interference or snap-fit connection of the spout 120 in the upright, stowed position to help maintain the stowed position.

One advantage related to the example fuel container devices disclosed herein is that the container 112 does not need to be tipped forward during dispensing of the contents of the container. The valves of the fuel container device 110 control fluid flow rather than a tipping action that directs fluid through a spout that is positioned, for example, at a top end of the container (e.g., at the fill opening 146) and is exposed to fluid only upon tipping of the container. Dispensing fuel may occur by holding fuel container device 110 in an upright position, manipulating the spout 120 into a desired dispense position, and operating the actuator assembly 122 to control the fluid flow out of the container 112 through the spout 120.

Figure 15:
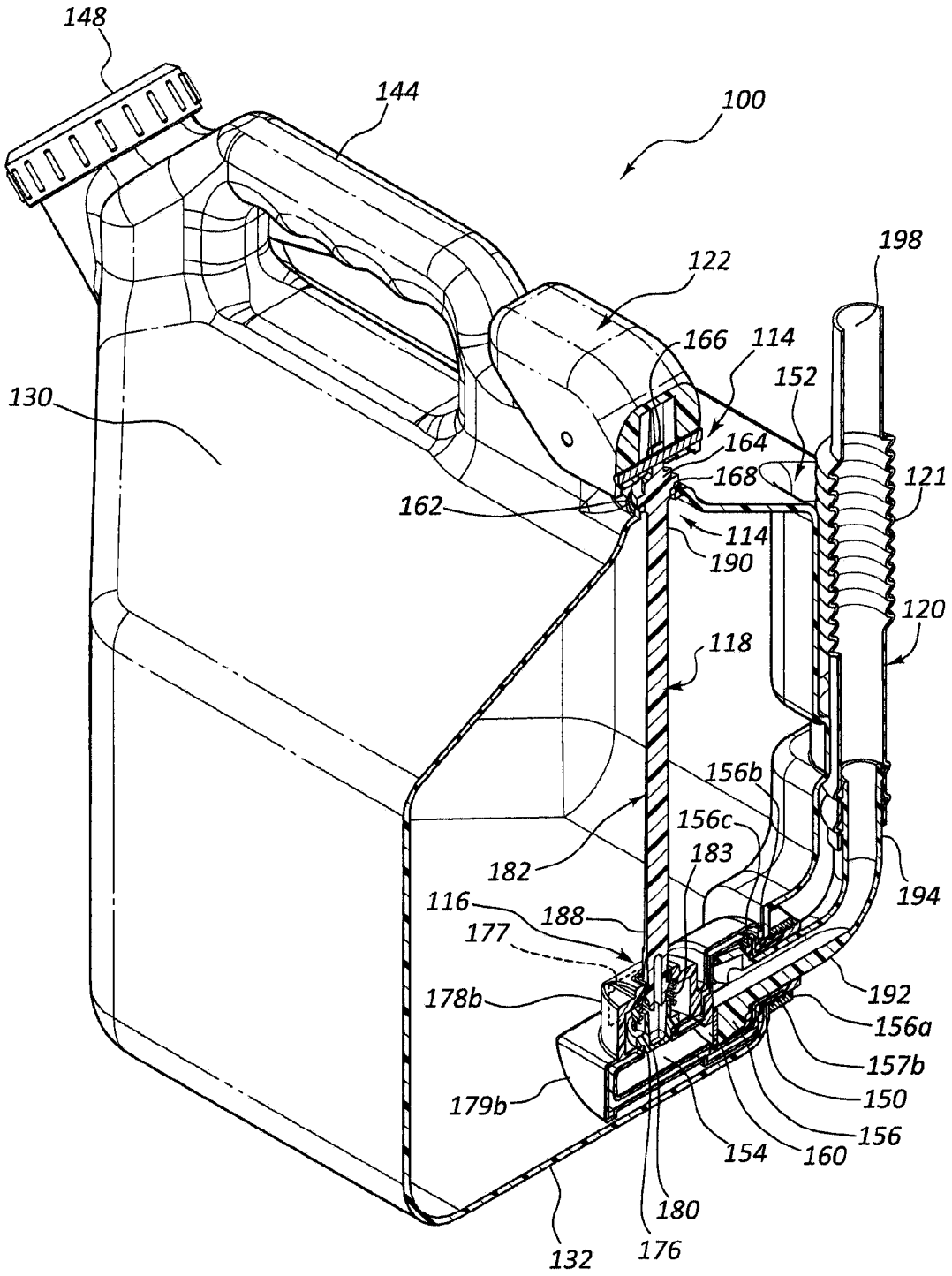
FIG. 15 is a perspective cross-sectional view of the fuel container device of FIG. 12 taken along cross-section indicators 15-15.

Referring to FIGS. 14-16, the air intake valve 114 includes an intake valve opening 162, an inlet plug 164, and an actuator connector 166. The intake valve opening 162 may be defined in the container 112, for example, at the top end 130 near the front side 134 of the container 112.

The inlet plug 164 may be configured to move into and out of contact with a tapered side surface 168 leading to the intake valve opening 162. The inlet plug 164 may have a generally cylindrical construction with a circular cross-section. The inlet plug 164 may include a plurality of sealing surfaces such as, for example, a plurality of o-ring type structures that contact the tapered side surface 168 to seal closed the intake valve opening 162. The inlet plug 164 may be connected to and carried by the actuator connector 166. The actuator connector 166 may extend vertically to provide a connection with the actuator assembly 122. Moving the actuator connector 166 vertically up and down may move the inlet plug 164 into and out of contact with the tapered side surface 168 to control air flow through the intake valve opening 162.

Referring to FIGS. 14-17B, the outlet valve 116 includes a tapered surface or seat 175 (see FIG. 14) leading to the outlet valve opening 174*a,b*, an outlet plug 176, at least one screen member 177, a screen support 178*a,b*, a housing 179*a,b*, a rod connector 180, a seal member 181, and a biasing member 183. The outlet plug 176 is movable relative to the tapered surface 175 to open or seal closed the outlet valve opening 174*a,b*. The outlet valve opening 174*a,b* and tapered surfaced 175 are defined in the housing 179*a,b*. The housing 179*a,b* may define, at least in part, a flow channel 154. The screens 177 may limit the flow of solid particles held in the container 112 through the outlet valve opening 174*a,b*. The screens 177 may include different types of materials and structures such as, for example, filter material in the form of cloth or fibrous material, or metal material such as a stainless steel screen. A connection feature 180*a* of the rod connector 180 may connect with a connection feature 189 of the flow valve rod assembly 118 to secure the outlet plug 176 to the flow valve rod assembly 118 (see FIG. 14). The biasing member 183 may be used to bias the seal member 181 and outlet plug 176 into a closed or sealed position (see FIGS. 15-16).

Operating the outlet valve 116 may include moving the outlet plug 176 into and out of contact with the tapered surface 175 to control fluid flow through the outlet valve opening 174*a,b*. In one example, the outlet plug 176 is moved vertically into and out of contact with the tapered surface 175. The outlet plug 176 may have a generally cylindrical construction with a circular cross-section. The outlet plug 176 may include at least one o-ring or other sealing structure. The outlet plug 176 may provide a plurality of sealing surfaces that contact the tapered surface 175 to seal closed the outlet valve opening 174*a,b*. The outlet valve 116 may be operable by moving the flow valve rod assembly 118.

A valve member 160 may be positioned within the flow channel 154 and sized to receive and interface with the flow channel valve 156 (see FIGS. 14 and 15). The valve member 160 may be a separate piece that interfaces with the flow channel valve 156, or may be integrally formed with other features such as a portion of a housing 179*a,b* of the outlet valve 116 (see FIGS. 14 and 15). The valve member 160 may include an opening 160*a* and a flow control portion 160*b*. Rotating the flow channel valve 156 relative to the valve member 160 control fluid flow from the flow channel 154 into the spout 120. For example, an opening into the flow channel valve 156 may rotate between a position covered or sealed closed by the flow control portion 160*b* to a position aligned with the opening 160*a* that permits flow into the spout 120.

The spout 120 may extend into the housing 179*a,b* through spout opening 157*a,b*. The flow channel valve 156 and valve member 160 may cooperate with the spout 120 to control fluid flow through the flow channel 154 and into the spout 120. The flow channel valve 156 may be operable between a closed position and an open position upon rotation of the spout 120 between the stowed position within the spout recess 152 and a dispense position rotated out of the spout recess 152 (see FIGS. 11 and 12). The flow channel valve 156 may include a connecting member 156*a* (e.g., a threaded nut), and first and second sealing members 156*b,c*. The connecting member 156*a* may releasably connect to a threaded portion of the spout opening 157*a,b*. The first and second sealing members 156*b,c* may create a seal with inner and outer surfaces of the container 112 (see FIG. 15).

The flow channel valve 156 may be referred to as a spout valve, a second fluid control valve, or a safety valve. The flow channel valve 156 may provide a secondary control of fluid flow out of the container 112. The flow channel valve 156 may limit flow until the spout 120 is in a dispense position that is rotated out of the stowed position shown in FIG. 10, even if the actuator assembly 122 has been operated to open the air intake valve 114 and outlet valve 116. The flow channel valve 156 may be carried on a portion of the spout 120 (e.g., the connector portion 192 as shown in FIG. 15). In other embodiments, the fuel container device is operable to dispense fluid without the use of a flow channel valve.

Referring again to FIGS. 14-16, the flow valve rod assembly 118 may include a rod 182 having a bottom end 188 and a top end 190. The bottom end 188 may be connected to the outlet plug 176 with the rod connector 180. The top end 190 may be connected to the inlet plug 164, for example, via the actuator connector 166. The flow valve rod assembly 118 may couple together the inlet plug 164 and outlet plug 176. The flow valve rod assembly 118 may provide concurrent operation of the air intake valve 114 and outlet valve 116.

Referring to FIGS. 10, 14 and 15, the spout 120 may include a connector portion 192 and an outlet portion 194. The connector portion 192 may extends through the outlet opening 150 and is in fluid communication with the flow channel 154 via the flow channel valve 156. The connector portion 192 may define a pivot axis X (see FIG. 14) about which the outlet portion 194 pivots between stowed and dispense positions. The outlet portion 194 may include an outlet opening 198. Fluid flowing from the container 112 may exit the fuel container device 100 through the outlet opening 198.

The outlet portion 194 may include features that assist in retaining the spout 120 in a stowed position (e.g., a recess or protrusion that interfaces with the connector portion 158 of the spout recess 152). The outlet portion 194 may include a bendable portion 121 or other feature that helps the user direct the outlet opening 198 into a desired dispense position when dispensing the contents of the container 112. The connector portion 192 and outlet portion 194 may have a generally circular cross-section and tubular construction. The connector portion 192 and outlet portion 194 may be formed as a single, integral piece. Alternatively, the connector portion 192 and outlet portion 194 may be separately formed pieces that are assembled together in a separate step.

The flow channel valve 156 may be positioned within or on an exterior of the connector portion 192. The flow channel valve 156 may provide a sealed interface between the connector portion 192 and the housing 179*a,b* and container 112.

Figure 12:
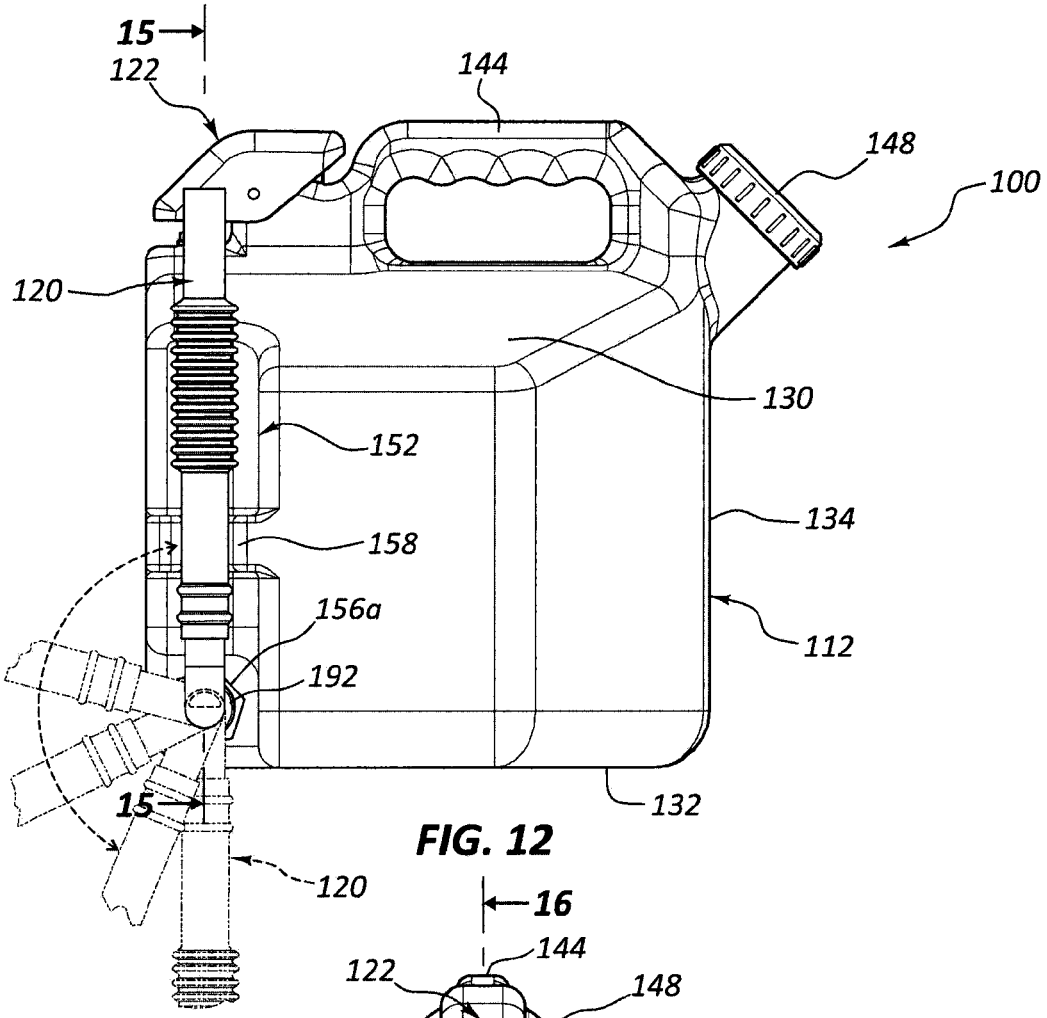
FIG. 12 is a right-side view of the fuel container device of FIG. 10.
Figure 13:
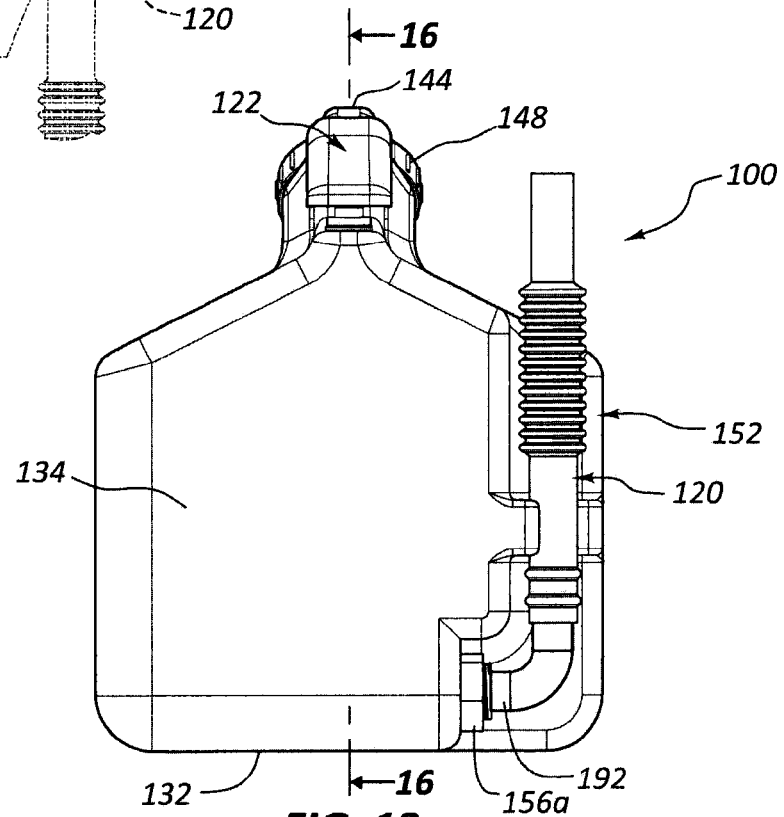
FIG. 13 is a front view of the fuel container device of FIG. 10.

Referring to FIG. 12, the actuator assembly 122 includes a connector portion 204, a pivot member 206, and an actuation portion 208. The actuation portion 208 is typically positioned adjacent to the handle portion 144. The pivot member 206 provides a pivot connection to the container 112. The pivot member 206 may include, for example, a pivot rod that extends into contact with a pivot surface (e.g., an aperture) of the container 112. The connector portion 204 may be connected to the actuator connector 166 with a pivot member 202.

Applying a force to the actuation portion 208 may pivot the actuator assembly 122 about the pivot member 206 to move the actuator connector 166 in an axial direction. Moving the actuator connector 166 in an axial direction may move the inlet plug 164 and outlet plug 176 in an axial direction to control flow through the intake valve opening 162 and outlet valve opening 174*a,b*, respectively. In some arrangements, the actuator assembly 122 is biased into a closed or sealed position. Applying a force to the actuation portion 108 sufficient to overcome the biasing forces may move the actuator connector 166 axially to open the intake valve opening 162 and outlet valve opening 174*a,b*.

Figure 17A:
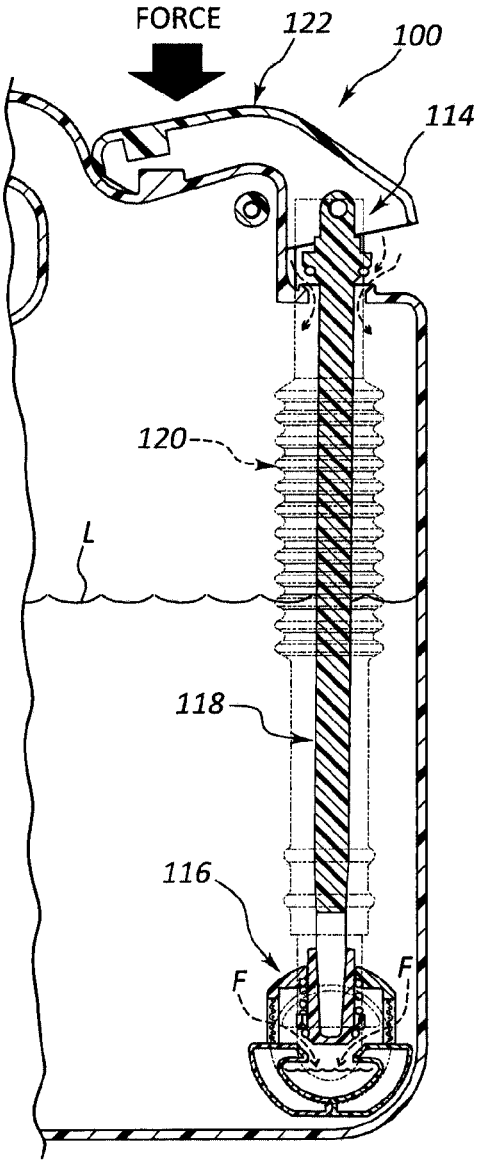
FIGS. 17A and 17B are cross-sectional views showing operation of the fuel container device of FIG. 10 between open and closed positions to control dispensing.
Figure 17B:
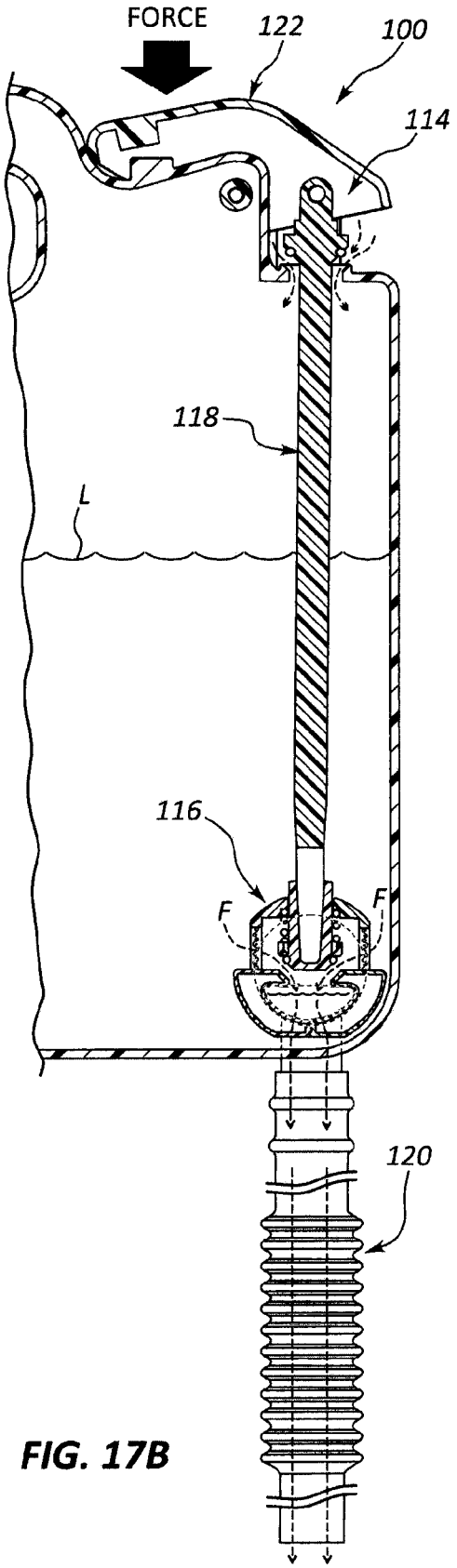

FIGS. 17A-B show operation of the actuator assembly 122 to provide fluid flow out of the container 112. Operating the actuator assembly 122 as shown in FIG. 17A provides air flow into the container 112 through the air intake valve 114, and fluid flow F into the flow channel 154 through the outlet valve 116. Moving the spout 120 from the stowed position shown in FIG. 17A to a dispense position shown in FIG. 17B provides fluid flow from the flow channel 154 into the spout 120 via the flow channel valve 156 (also referred to as a spout valve). Fluid flow from the container 112 out through the spout 120 may be stopped by either releasing the actuator assembly 122 to close the air intake valve 114 and outlet valve 116, or moving the spout 120 back into the stowed position shown in FIG. 17A to close the flow channel valve 156.

While this invention has been described with reference to certain specific embodiments and examples, it will be recognized by those skilled in the art that many variations are possible without departing from the scope and spirit of this invention. The invention, as described by the claims, is intended to cover all changes and modifications of the invention which do not depart from the spirit of the invention. The words "including" and "having," as used in the specification, including the claims, shall have the same meaning as the word "comprising."

I claim:

1. A fuel container, comprising:

a container having a top end portion, a bottom end portion, a sidewall, and a hollow interior;

a spout rotatable between a retracted upright position and an extended downward directed position relative to the container;

an enclosed intermediate outlet housing extending from and positioned internal the hollow interior of the container, the intermediate outlet housing comprising a housing and a cavity formed within the housing, the cavity being in fluid communication with the spout;

an outlet valve positioned at the bottom end portion of the container and operable to control fluid flow into the cavity of the intermediate outlet housing, the outlet valve including a stopper plug movable vertically between a closed position and an open position;

an air intake valve positioned at the top end portion and including an air intake plug;

an actuator operable to concurrently open both the outlet valve and the air intake valve by moving a portion of the actuator vertically downward, which moves the stopper plug and air intake plug vertically upward, the actuator being located along a top surface of the top end portion.

2. The fuel container of claim 1, further comprising a flow valve rod coupled to the outlet valve and the air intake valve, wherein the actuator is operable to move the flow valve rod to concurrently open the outlet valve and the air intake valve.

3. The fuel container of claim 1, wherein the stopper plug in the closed position seals a fluid path between the hollow interior and the cavity, and in the open position permits fluid flow between the hollow interior and the cavity.

4. The fuel container of claim 2, wherein the flow valve rod is a single-piece rod that extends from the air intake valve to the outlet valve.

5. The fuel container of claim 2, wherein the flow valve rod moves vertically within the hollow interior when the container is oriented upright.

6. The fuel container of claim 1, further comprising a flow valve rod coupled between the air intake valve and the outlet valve, wherein operation of the air intake valve with the actuator moves the flow valve rod to operate the outlet valve.

7. The fuel container of claim 6, wherein at least one of the air intake valve and the outlet valve is mounted directly to the flow valve rod.

8. The fuel container of claim 6, wherein the flow valve rod is positioned within the hollow interior.

9. The fuel container of claim 1, wherein the air intake valve and the outlet valve are biased into closed positions.

10. The fuel container of claim 1, wherein the container includes a handle portion positioned at the top end portion of the container, and the actuator is operable at a location adjacent to the handle portion.

11. A fuel storage device, comprising:

a container having top and bottom surfaces and side surfaces, the container being supported on the bottom surface when the container is oriented in an upright position;

an enclosed intermediate outlet housing extending from and positioned internal the container, the intermediate outlet housing comprising a housing and a cavity formed within the housing;

an air intake valve coupled in fluid communication with a source of air and operable to control airflow into the container;

an outlet valve in fluid communication with a volume of fluid carried in the container and operable to control fluid flow into the cavity of the intermediate outlet housing;

a flow valve rod connected to the air intake valve and the outlet valve, wherein moving the flow valve rod vertically upward while the container is in the upright position concurrently opens the air intake valve and outlet valve;

a spout in fluid communication with the cavity of the intermediate outlet housing and moveable between a dispense position and a stowed position;

a handle located along the top surface of the container.

12. The fuel storage device of claim 11, further comprising an actuator connected to the air intake valve, wherein operating the actuator to open and close the air intake valve causes the flow valve rod to open and close the outlet valve.

13. The fuel storage device of claim 11, wherein the outlet valve is positioned at a bottom end portion of the container and the air intake valve is positioned at a top surface of the container.

14. The fuel storage device of claim 11, wherein the flow valve rod and the outlet valve are positioned within the container.

15. The fuel storage device of claim 12, wherein the container includes a handle portion positioned on the top surface of the container, and the actuator is operable by a user's hand while the hand grasps the carrying handle of the fuel container.

16. A method of operating a fuel container assembly, the method comprising;

providing an air intake valve, an outlet valve, a valve actuator, a container configured to hold a volume of fuel, a spout, a handle, and an enclosed intermediate outlet housing extending from the container, the air intake valve comprising an air intake plug and an air intake valve seat, the outlet valve comprising a stopper plug and an outlet valve seat, and the intermediate outlet housing comprising a housing and a cavity formed within the housing, and the handle and valve actuator located adjacent to each other along a top surface at a top end portion of the container;

rotating a portion of the actuator downward, which moves the air intake plug vertically relative to the air intake valve seat to open the air intake valve to provide a supply of air into the container, and concurrently moves the stopper plug vertically relative to the outlet valve seat to open the outlet valve to permit flow of the volume of fuel from the container into the cavity of the housing;

rotating the spout between an upward-pointing stowed position and a downward-pointing dispense position to permit flow of the volume of fuel from the cavity of the housing through the spout.

17. The method of claim 16, wherein opening the air intake valve and the outlet valve occurs concurrently with axial movement of a flow valve rod that interconnects the air intake valve and the outlet valve.

18. The method of claim 16, wherein when the outlet valve is opened, it is submerged in fuel at a bottom end portion of the container, and when the spout is in the dispense position, fuel is dispensed without tilting the container.

19. The method of claim 16, further comprising providing a container handle, and opening the air intake valve and the outlet valve using one hand of a user while holding the container handle with the hand.

20. The method of claim 16, further comprising providing a flow valve rod that interconnects the air intake valve and the outlet valve, the flow valve rod being moveable vertically by the valve actuator when the container is oriented upright.

21. The fuel storage device of claim 11, further comprising an inlet opening positioned on the top surface of the container, and a lid removably mounted to the inlet opening.

22. The fuel storage device of claim 12, wherein operating the actuator includes rotating the actuator about a pivot member.

* * * * *